US008223083B2

(12) United States Patent
Wong et al.

(10) Patent No.: US 8,223,083 B2
(45) Date of Patent: Jul. 17, 2012

(54) MULTIBAND MONOPOLE SLOT ANTENNA

(75) Inventors: Kin-Lu Wong, Taipei Hsien (TW); Li-Chun Lee, Tapei Hsien (TW)

(73) Assignee: ACER Inc., Tapei Hsien (TW)

( * ) Notice: Subject to any disclaimer, the term of this patent is extended or adjusted under 35 U.S.C. 154(b) by 329 days.

(21) Appl. No.: 12/269,924

(22) Filed: Nov. 13, 2008

(65) Prior Publication Data

US 2010/0045556 A1 Feb. 25, 2010

(30) Foreign Application Priority Data

Aug. 20, 2008 (TW) ..... 97131769 A

(51) Int. Cl.
*H01Q 13/10* (2006.01)
*H01Q 1/24* (2006.01)
*H01Q 1/48* (2006.01)

(52) U.S. Cl. ..... 343/770; 343/702; 343/846

(58) Field of Classification Search ..... 343/770, 343/702, 846

See application file for complete search history.

(56) References Cited

U.S. PATENT DOCUMENTS

| | | | | |
|---|---|---|---|---|
| 2,942,263 | A * | 6/1960 | Baldwin | 343/767 |
| 6,992,637 | B2 * | 1/2006 | Hwang et al. | 343/770 |
| 2003/0054678 | A1 * | 3/2003 | Grek | 439/79 |
| 2004/0056812 | A1 | 3/2004 | Sabet et al. | |
| 2009/0153409 | A1 * | 6/2009 | Chiang et al. | 343/702 |

FOREIGN PATENT DOCUMENTS

TW I293215 2/2008

OTHER PUBLICATIONS

"A Commercial Perspective on the Development and Integration of an 802.11a/b/g HiperLan/WLAN Antenna into Laptop Computers," Randy Bancroft, IEEE Antennas and Propagation Magazine, vol. 48, No. 4, Aug. 2006.*

"Slot-Line Transitions," Jeffrey B. Knorr, IEEE Transactions on Microwave Theory and Techniques, May 1974, pp. 548-554.*

Peter Lindberg, Erik Ojefors and Anders Rydberg, Wideband Slot Antenna for Low-Profile Hand-held Terminal Applications, Proceedings of the 9th European Conference on Wireless Technology, Sep. 2006, pp. 403-406, 2-9600551-5-2 © 2006 EuMA, Manchester UK.

Chun-I Lin and Kin-Lu Wong, Printed Monopole Slot Antenna for Internal Multiband Mobile Phone Antenna, IEEE Transactions on Antennas and Propagation, Dec. 2007, pp. 3690-3697, vol. 55, No. 12, IEEE.

* cited by examiner

*Primary Examiner* — Jacob Y Choi
*Assistant Examiner* — Graham Smith
(74) *Attorney, Agent, or Firm* — Alan Kamrath; Kamrath IP Lawfirm, PA

(57) ABSTRACT

A multiband monopole slot antenna includes a ground plane, a dielectric substrate, a radiating portion, and a microstrip feedline. The dielectric substrate is connected to an edge of the ground plane and extends toward the opposite direction of the ground plane. The radiating portion is on the metal surface of the dielectric substrate and includes a first monopole slot, a second monopole slot and a third monopole slot. The microstrip feedline is on the surface opposite to the metal surface of the dielectric substrate. A first end of the microstrip feedline is connected to a signal source, and a second end of the microstrip feedline is an open end. The microstrip feedline passes over the first, second, and third monopole slots. A section of the microstrip feedline which passes over the third monopole slot is parallel to the third monopole slot, and the microstrip feedline is generally of a step shape.

18 Claims, 3 Drawing Sheets

MULTIBAND MONOPOLE SLOT ANTENNA

BACKGROUND OF THE INVENTION

1. Field of the Invention

The present invention relates to a slot antenna and, more particularly, to a multiband monopole slot antenna suitable for application in mobile communication devices.

2. Description of the Related Art

The fast development of mobile communication technology and its related market has created various applications for notebook computers, such as traditional wireless local area networks (WLAN) and mobile communications. Among all the factors affecting mobile communication applications, the performance of the antenna is critical to wireless transmission and reception quality. Presently, antennas embedded in notebook computers are mostly used for WLAN operation.

In the prior art, such as Taiwan Patent No. I293215, entitled "Dual-Band Inverted-F Antenna", a ground plane built in the backplane of the LCD display of a notebook computer and a dual-band antenna designed thereon is disclosed. However, the antenna is only suitable for WLAN operation due to its size. It is difficult to fit into a mobile communication device when it is applied as a multiband antenna used in a mobile communication system.

Therefore, it is necessary to provide a multiband antenna with a small size to overcome the deficiency of the techniques of the prior art.

SUMMARY OF THE INVENTION

It is an objective of the present invention to provide an antenna for mobile communication devices covering operating bands such as the GSM850/900/DCS/PCS/UMTS bands and providing advantages such as a simple structure and a compact size. The antenna can easily be printed or etched on a dielectric substrate to fit into mobile communication devices such as notebook computers. In order to achieve the above objectives, the antenna disclosed in the present invention comprises: a ground plane, a dielectric substrate, a radiating portion and a microstrip feedline. The dielectric substrate is connected to an edge of the ground plane and extends toward the opposite direction of the ground plane. The dielectric substrate has a metal surface formed on the dielectric substrate by printing or etching, and the metal surface is electrically connected to the ground plane via at least one electrical connecting point. The radiating portion is on the metal surface of the dielectric substrate and comprises at least a first monopole slot, a second monopole slot, and a third monopole slot. The first, the second, and the third monopole slots each have an open end and a terminal. The open end is on a side edge of the metal surface, and the terminal extends inward the metal surface. Furthermore, the second monopole slot is substantially parallel to the first monopole slot, and the third monopole slot is positioned between the first monopole slot and the second monopole slot. The microstrip feedline is on the surface opposite to the metal surface of the dielectric substrate and can be printed or etched on the dielectric substrate. A first end of the microstrip feedline is connected to a signal source, and a second end of the microstrip feedline is an open end. The microstrip feedline passes over the first, second, and third monopole slots. A section of the microstrip feedline which passes over the third monopole slot is substantially parallel to the third monopole slot, and the microstrip feedline is generally of a step shape.

The antenna disclosed in the present invention is designed as a multiband monopole slot antenna operated in communication bands such as GSM850 (824.about.894 MHz), GSM900 (890.about.960 MHz), and DCS/PCS/UMTS (1710.about.1880 MHz/1850.about.1990 MHz/1920.about.2170 MHz). The multiband monopole slot antenna is series-fed by the microstrip feedline in different positions of the three monopole slots. The microstrip feedline is generally of a step shape and comprises a section parallel to one of the three monopole slots for controlling the feeding position of the monopole slots so as to generate a resonant mode in the lower-frequency band, thereby enabling multiband operation covering the GSM850/900 and DCS/PCS/UMTS bands.

In one embodiment of the present invention, the first monopole slot can generate a resonant mode near a quarter wavelength of a lower frequency at about 900 MHz, the second monopole slot can generate a resonant mode near a quarter wavelength of a higher frequency at about 1900 MHz, and the third monopole slot can also generate a resonant mode near a quarter wavelength of the lower frequency at about 900 MHz to form a lower-frequency band with the resonant mode generated by the first monopole slot. In addition, the resonant mode generated by the second monopole slot can form a higher-frequency band. The central frequencies of the lower-frequency band and the higher-frequency band can be adjusted by changing the feeding positions of the microstrip feedline corresponding to the first and the second monopole slots. Furthermore, a section of the microstrip feedline parallel to the third monopole slot can also effectively adjust the resonant mode of the third monopole slot to provide good impedance matching. Therefore, the present invention can enable multiband operation covering the GSM850/900 and DCS/PCS/UMTS bands.

DETAILED DESCRIPTION OF THE PREFERRED EMBODIMENTS

The advantages and innovative features of the invention will become more apparent from the following detailed description when taken in conjunction with the accompanying drawings.

Figure 1:
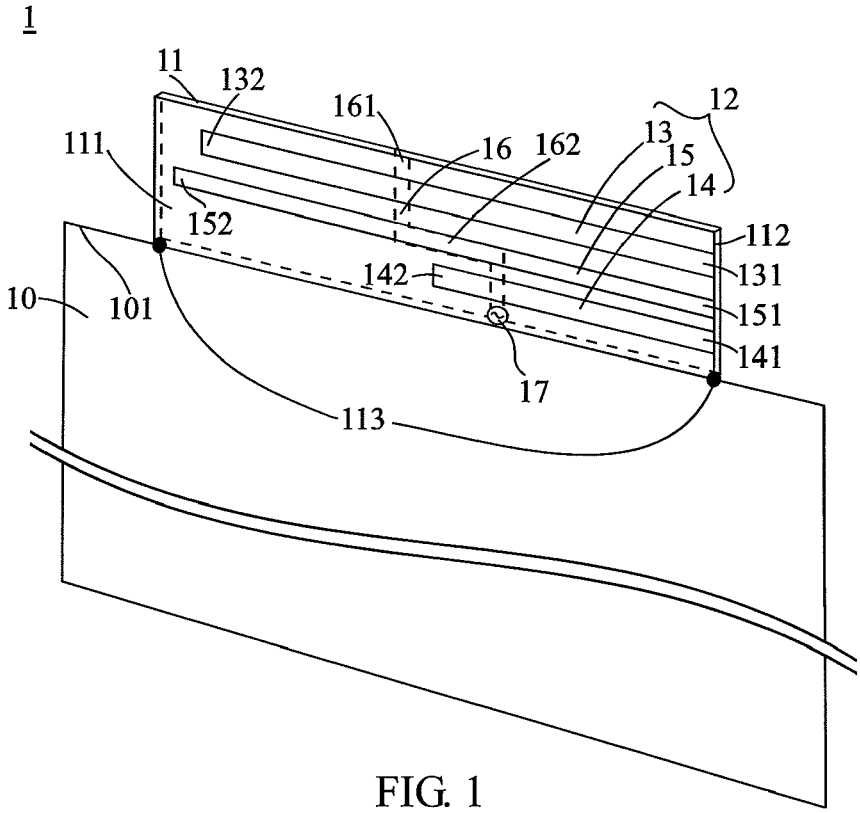
FIG. 1 illustrates a structural view of a multiband antenna in a first embodiment of the present invention.

FIG. 1 illustrates a structural view of a multiband antenna in a first embodiment of the present invention. The multiband antenna 1 comprises a ground plane 10, a dielectric substrate 11, a radiating portion 12, and a microstrip feedline 16. In this embodiment, the ground plane 10 is a metal backplane of an LCD display of a notebook computer.

The dielectric substrate 11 is at an edge 101 of the ground plane and extends toward the opposite direction of the ground plane 10. The dielectric substrate 11 also comprises a metal surface 111 electrically connected to the ground plane 10 via at least one electrical connecting point 113.

The radiating portion 12 on the metal surface 111 of the dielectric substrate 11 comprises at least a first monopole slot 13, a second monopole slot 14, and a third monopole slot 15.

The first monopole slot 13 comprises an open end 131 and a terminal 132. The open end 131 is on a side edge 112 of the metal surface 111, and the terminal 132 extends inward the metal surface 111.

The second monopole slot 14 is substantially parallel to the first monopole slot 13 and comprises an open end 141 and a terminal 142. The open end 141 is on the side edge 112 of the metal surface 111, and the terminal 142 extends inward the metal surface 111.

The third monopole slot 15 is positioned between the first monopole slot 13 and the second monopole slot 14 and comprises an open end 151 and a terminal 152. The open end 151 is on the side edge 112 of the metal surface 111, and the terminal 152 extends inward the metal surface 111.

The microstrip feedline 16 is generally of a step shape and is on the surface opposite to the metal surface 111 of the dielectric substrate 11. A first end of the microstrip feedline 16 is connected to a signal source 17, and a second end of the microstrip feedline 16 is an open end 161. The microstrip feedline 16 passes over the first monopole slot 13, the second monopole slot 14, and third monopole slot 15. A section 162 of the microstrip feedline 16 which passes over the third monopole slot 15 is substantially parallel to the third monopole slot 15.

In this embodiment, the ground plane 10, being a metal backplane of an LCD display of a notebook computer, is designed to have a length of 260 mm and a width of 200 mm. The first monopole slot 13 of the radiating portion 12 has a length of 55 mm (about a quarter wavelength at 900 MHz), the second monopole slot 14 has a length of 30 mm (about a quarter wavelength at 1900 MHz), and the third monopole slot 15 has a length of 58 mm (about a quarter wavelength at 900 MHz). Furthermore, the radiating portion 12 is printed or etched on the dielectric substrate 11, which is 60 mm long, 10 mm wide, and 0.8 mm thick.

Figure 2:
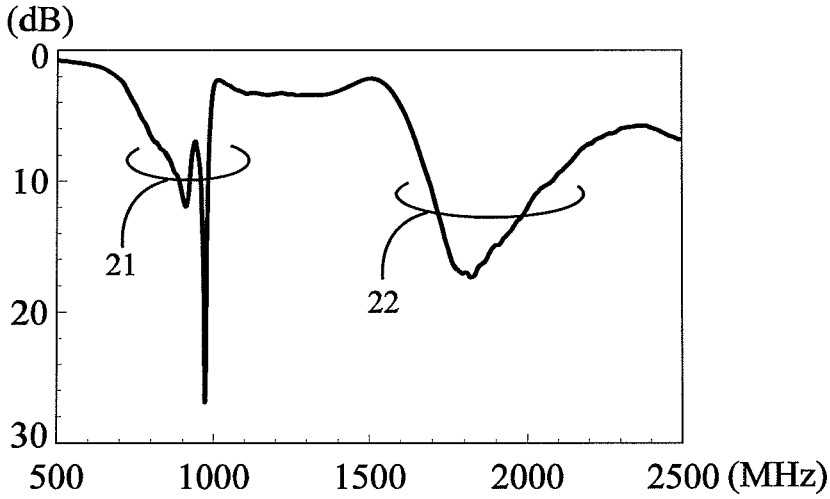
FIG. 2 shows a measurement of the return loss of the first embodiment of the present invention.

FIG. 2 shows a measurement of the return loss of the first embodiment of the present invention. The first monopole slot 13 and the third monopole slot 15 can respectively generate a quarter-wavelength resonant mode to jointly form a lower-frequency band 21 of the multiband antenna 1, and the second monopole slot 14 can generate a quarter-wavelength resonant mode to form a higher-frequency band 22. From experimental results, under the definition of 6-dB return loss, the operating bandwidth of the lower-frequency band is about 200 MHz (785.about.985 MHz), which covers the GSM850 (824.about.894 MHz) and the GSM900 (890.about.960 MHz) bands), and the operating bandwidth of the higher-frequency band is about 670 MHz (1630.about.2300 MHz), which covers the DCS (1710.about.1880 MHz), PCS (1850.about.1990 MHz), and UMTS (1920.about.2170 MHz) bands.

Figure 3:
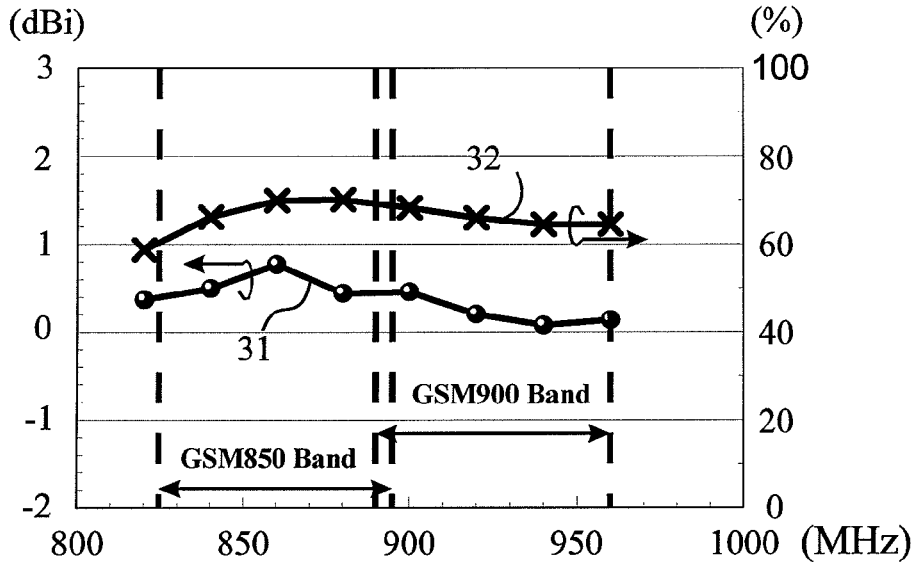
FIG. 3 shows a gain and a radiation efficiency of the first embodiment of the present invention in the lower-frequency band.
Figure 4:
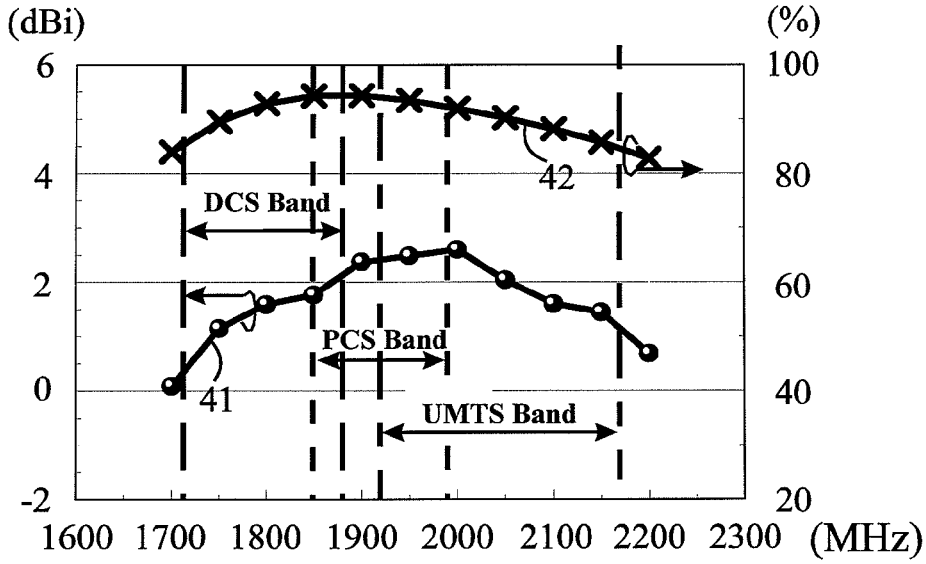
FIG. 4 shows a gain and a radiation efficiency of the first embodiment of the present invention in the higher-frequency band.

FIG. 3 and FIG. 4 respectively show the gain and the radiation efficiency of the first embodiment of the present invention in a lower-frequency band 21 and a higher-frequency band 22. From the figures, the antenna gain 31 in the lower-frequency band 21 ranges from 0.1 dBi to 0.8 dBi, and the radiation efficiency 32 ranges from 55% to 70%, the antenna gain 41 in the higher-frequency band 22 ranges from 0.4 dBi to 2.5 dBi, and the radiation efficiency 42 ranges from 82% to 94%. Therefore, the radiation characteristics of the multiband antenna 1 are suitable for application in mobile communication devices.

Figure 5:
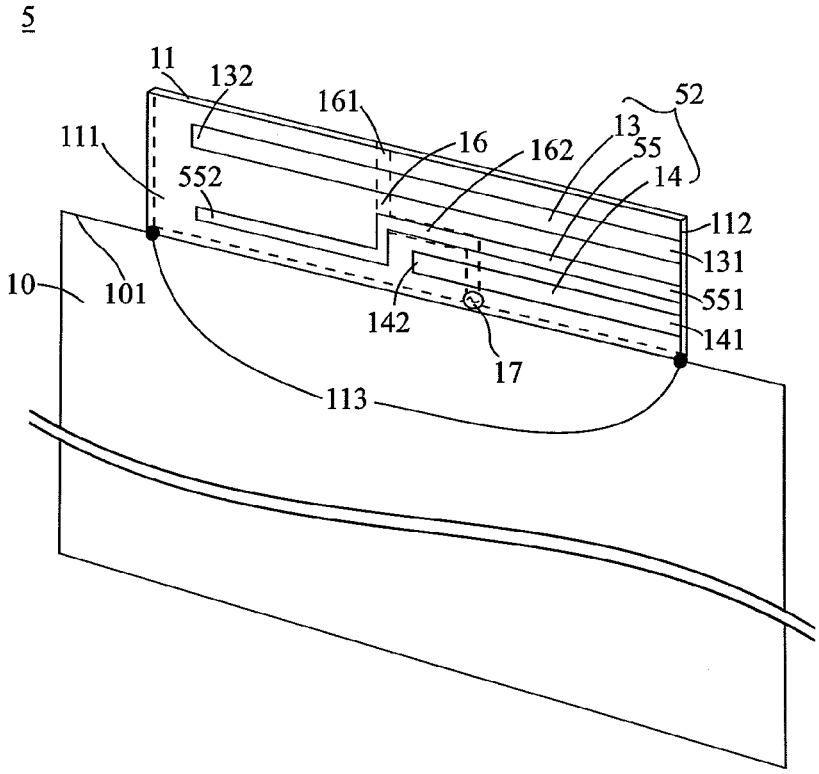
FIG. 5 illustrates a structural view of the multiband antenna in a second embodiment of the present invention.

FIG. 5 illustrates a structural view of the multiband antenna in a second embodiment of the present invention. In this embodiment, a radiating portion 52 includes a third monopole slot 55 of the multiband antenna 5 comprises at least two bendings between an open end 551 and a terminal 552 and substantially forms a step shape to keep the terminal 132 of the first monopole slot 13 separated from the terminal 552 of the third monopole slot 55 at a desired distance. Other structures of the antenna 5 are the same as those of the antenna 1 of the first embodiment.

Figure 6:
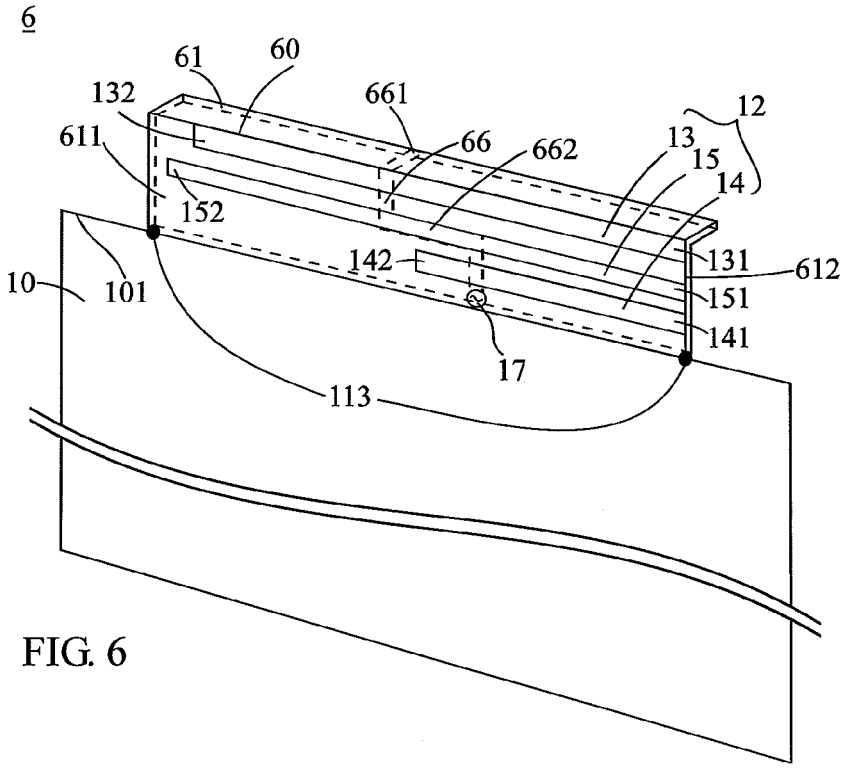
FIG. 6 illustrates a structural view of the multiband antenna in a third embodiment of the present invention.

FIG. 6 illustrates a structural view of the multiband antenna in a third embodiment of the present invention. In this embodiment, a radiating portion 612 of the dielectric substrate of the multiband antenna 6 includes first and second portions 61 and 611 and has a bending to allow the portion 61 of the dielectric substrate to be substantially vertical to the ground plane. A microstrip feedline 66 is generally of a step shape having a section 662 passing over the third monopole slot 15 and having an open end 661. Other structures of the antenna 6 are the same as those of the antenna 1 of the first embodiment. In this way, the multiband antenna 6 can have various heights and thicknesses to allow placement in different positions in mobile communication devices.

It is noted that the antennas in the second and the third embodiments can also provide multiband operations as described in the first embodiment.

It is noted that the above-mentioned embodiments are only for illustration, and it is intended that the present invention cover modifications and variations of this invention provided they fall within the scope of the following claims and their equivalents. Therefore, it will be apparent to those skilled in the art that various modifications and variations can be made to the structure of the present invention without departing from the scope or spirit of the invention.

What is claimed is:

1. A multiband monopole slot antenna comprising:

a ground plane;

a dielectric substrate connected to an edge of the ground plane and extending toward the opposite direction of the ground plane, the dielectric substrate having a metal surface electrically connected to the ground plane via at least one electrical connecting point; and a radiating portion on the metal surface of the dielectric substrate comprising:

a first monopole slot having a first open end and a first terminal, wherein the first open end is disposed on a side edge of the metal surface, and the first terminal is extended inward the metal surface;

a second monopole slot substantially parallel to the first monopole slot, the second monopole slot having a second open end and a second terminal, wherein the second open end is disposed on a side edge of the metal surface, and the second terminal is extended inward the metal surface;

a third monopole slot disposed between the first monopole slot and the second monopole slot, the third monopole slot having a third open end and a third terminal, wherein the third open end is disposed on a side edge of the metal surface, and the third terminal is extended inward the metal surface, wherein the third monopole slot comprises at least two bendings forming a step shape and includes an initial section, an intermediate section extending from the initial section at a non-parallel angle to the initial section, and a final section extending from the intermediate section extending at a non-parallel angle opposite to the initial section, wherein the second monopole slot and the final section are equally spaced from the first monopole slot, with the second monopole slot being shorter than the initial section, with the second monopole slot being spaced from the initial section and the intermediate section, and wherein the second section is substantially parallel to the initial section; and a microstrip feedline formed generally of a step shape including a first section, a second section extending from the first section at a non-parallel angle to the first section, and a third section extending from the second section at a non-parallel angle opposite to the first section, wherein the microstrip feedline is on the surface opposite to the metal surface of the dielectric substrate; wherein a first end of the first section of the microstrip feedline is connected to a signal source, and a second end of the third section of the microstrip feedline is an open end; wherein the micro strip feedline passes over the first, second and third monopole slots; wherein the second section of the microstrip feedline is substantially parallel to the third monopole slot with the second section between the first and third sections located between the third open end and the third terminal, with the first, second and third monopole slots located intermediate the second end of the third section and the first end of the first section, wherein the first terminal of the first monopole slot is separated a distance from the third terminal of the third monopole slot greater than the first open end and the third open end by the step shape of the third monopole slot.

2. The multiband monopole slot antenna as claimed in claim 1, wherein the ground plane is a metal backplane of an LCD display of a notebook computer.

3. The multiband monopole slot antenna as claimed in claim 1, wherein the metal surface is printed or etched on the dielectric substrate.

4. The multiband monopole slot antenna as claimed in claim 1, wherein the microstrip feedline, is printed or etched on the dielectric substrate.

5. The multiband monopole slot antenna as claimed in claim 1, wherein the first monopole slot has a length substantially a quarter wavelength of a central frequency of a lower-frequency band of the antenna.

6. The multiband monopole slot antenna as claimed in claim 1, wherein the second monopole slot has a length substantially a quarter wavelength of a central frequency of a higher-frequency band of the antenna.

7. The multiband monopole slot antenna as claimed in claim 1, wherein the third monopole slot has a length substantially a quarter wavelength of a central frequency of a lower-frequency band of the antenna.

8. The multiband monopole slot antenna as claimed in claim 1, wherein the dielectric substrate has a bending to allow a portion of the dielectric substrate to be substantially vertical to the ground plane.

9. The multiband monopole slot antenna as claimed in claim 1, wherein the first monopole slot and the third monopole slot are used for generating a lower-frequency resonant mode; and wherein the second monopole slot is used for generating a higher-frequency resonant mode.

10. The multiband monopole slot antenna as claimed in claim 1, wherein the first monopole slot has a length substantially a quarter wavelength of a central frequency of a first lower-frequency band of the antenna, the second monopole slot has a length substantially a quarter wavelength of a central frequency of a higher-frequency band of the antenna, and the third monopole slot has a length substantially a quarter wavelength of a central frequency of a second lower-frequency band of the antenna, wherein the central frequency of the first lower-frequency band is different from the central frequency of the second lower-frequency band.

11. A multiband monopole slot antenna comprising:

a ground plane;

a dielectric substrate connected to an edge of the ground plane and extending toward the opposite direction of the ground plane, the dielectric substrate having a metal surface electrically connected to the ground plane via at least one electrical connecting point; and a radiating portion on the metal surface of the dielectric substrate comprising:

a first monopole slot having a first open end and a first terminal, wherein the first open end is disposed on a side edge of the metal surface, and the first terminal is extended inward the metal surface;

a second monopole slot substantially parallel to the first monopole slot, the second monopole slot having a second open end and a second terminal, wherein the second open end is disposed on a side edge of the metal surface, and the second terminal is extended inward the metal surface;

a third monopole slot disposed between the first monopole slot and the second monopole slot, the third monopole slot having a third open end and a third terminal, wherein the third open end is disposed on a side edge of the metal surface, and the third terminal is extended inward the metal surface, wherein the third monopole slot comprises at least two bendings forming a step shape and includes an initial section, an intermediate section extending from the initial section at a non-parallel angle to the initial section, and a final section extending from the intermediate section extending at a non-parallel angle opposite to the initial section, wherein the second monopole slot and the final section are equally spaced from the first monopole slot, with the second monopole slot being shorter than the initial section, with the second monopole slot being spaced from the initial section and the intermediate section, and wherein the second section is substantially parallel to the initial section; and a microstrip feedline formed generally of a step shape including a first section, a second section extending from the first section at a non-parallel angle to the first section, and a third section extending from the second section at a non-parallel angle, wherein the microstrip feedline is on the surface opposite to the metal surface of the dielectric substrate; wherein a first end of the first section of the microstrip feedline is connected to a signal source, and a second end of the third section of the microstrip feedline is an open end; wherein the microstrip feedline passes over the first, second and third monopole slots; wherein the second section of the microstrip feedline is substantially parallel to the third monopole slot and overlaps the third monopole slot with the second section between the first and third sections located between the third open end and the third terminal, wherein the first terminal of the first monopole slot is separated a distance from the third terminal of the third monopole slot greater than the first open end and the third open end by the step shape of the third monopole slot.

12. The multiband monopole slot antenna as claimed in claim 11, wherein the ground plane is a metal backplane of an LCD display of a notebook computer.

13. The multiband monopole slot antenna as claimed in claim 11, wherein the first monopole slot has a length substantially a quarter wavelength of a central frequency of a lower-frequency band of the antenna.

14. The multiband monopole slot antenna as claimed in claim 11, wherein the second monopole slot has a length substantially a quarter wavelength of a central frequency of a higher-frequency band of the antenna.

15. The multiband monopole slot antenna as claimed in claim 11, wherein the third monopole slot has a length substantially a quarter wavelength of a central frequency of a lower-frequency band of the antenna.

16. The multiband monopole slot antenna as claimed in claim 11, wherein the dielectric substrate has a bending to allow a portion of the dielectric substrate to be substantially vertical to the ground plane.

17. The multiband monopole slot antenna as claimed in claim 11, wherein the first monopole slot and the third monopole slot are used for generating a lower-frequency resonant mode; and wherein the second monopole slot is used for generating a higher-frequency resonant mode.

18. The multiband monopole slot antenna as claimed in claim 11, wherein the first monopole slot has a length substantially a quarter wavelength of a central frequency of a first lower-frequency band of the antenna, the second monopole slot has a length substantially a quarter wavelength of a central frequency of a higher-frequency band of the antenna, and the third monopole slot has a length substantially a quarter wavelength of a central frequency of a second lower-frequency band of the antenna, wherein the central frequency of the first lower-frequency band is different from the central frequency of the second lower-frequency band.

* * * * *